US009281176B2

(12) United States Patent
Kim et al.

(10) Patent No.: US 9,281,176 B2
(45) Date of Patent: Mar. 8, 2016

(54) MICROWAVE PLASMA LAMP WITH ROTATING FIELD

(71) Applicant: TAEWON LIGHTING CO., LTD., Seoul (KR)

(72) Inventors: Jin-Joong Kim, Seoul (KR); Kyoung-Shin Kim, Gyeonggi-do (KR)

(73) Assignee: TAEWON LIGHTING CO., LTD., Seoul (KR)

( * ) Notice: Subject to any disclaimer, the term of this patent is extended or adjusted under 35 U.S.C. 154(b) by 0 days.

(21) Appl. No.: 14/574,745

(22) Filed: Dec. 18, 2014

(65) Prior Publication Data

US 2015/0155155 A1 Jun. 4, 2015

Related U.S. Application Data

(63) Continuation of application No. PCT/KR2013/005072, filed on Jun. 10, 2013.

(30) Foreign Application Priority Data

Jun. 29, 2012 (KR) ..... 10-2012-0070746

(51) Int. Cl.
*H01J 65/04* (2006.01)
*H01P 1/17* (2006.01)

(52) U.S. Cl.
CPC ..... *H01J 65/044* (2013.01); *H01P 1/173* (2013.01)

(58) Field of Classification Search
CPC ..... H01J 7/46; H01J 61/28; H01J 65/04; H01J 65/042; H01J 65/044; H01P 1/182
USPC ..... 315/39, 48, 246, 248, 111.21, 111.41; 313/231.71, 634, 636
See application file for complete search history.

(56) References Cited

U.S. PATENT DOCUMENTS 3,979,624 A 9/1976 Liu et al.
5,227,698 A 7/1993 Simpson et al.

(Continued)

FOREIGN PATENT DOCUMENTS

CN 1293608 C 1/2007
CN 100567567 C 12/2009

(Continued)

OTHER PUBLICATIONS

International Search Report for Application No. PCT/US 01/09199 dated Oct. 10, 2001.

(Continued)

*Primary Examiner* — Jimmy Vu
(74) *Attorney, Agent, or Firm* — Jenkins, Wilson, Taylor & Hunt, P.A.

(57) ABSTRACT

Provided is a microwave plasma discharge lamp apparatus which includes a rectangular waveguide having a rectangular shape one end of which is closed and the other end is open and receiving a microwave through an opening to put out linearly polarized microwaves; a discharge lamp; a resonator cavity, formed in a cylindrical shape, one end of which is open, which is disposed to surround the discharge lamp, and which is made of a conductive mesh, thereby allowing the passage of the light from the discharge lamp; and a phase shifter, which has a cross-shaped waveguide opened in a propagation direction of the linearly polarized microwaves, is disposed between the other end of the rectangular waveguide and one end of the resonator cavity, and receives the linearly polarized microwaves from the rectangular waveguide to generate elliptically polarized microwaves in the cylindrical resonator cavity. The elliptically polarized microwaves discharge the discharge lamp.

17 Claims, 13 Drawing Sheets

(56) References Cited

U.S. PATENT DOCUMENTS

| | | | | |
|---|---|---|---|---|
| 5,404,076 | A | 4/1995 | Dolan et al. | |
| 5,479,072 | A | 12/1995 | Dakin et al. | |
| 5,556,549 | A | 9/1996 | Bose et al. | |
| 5,565,074 | A | 10/1996 | Sato et al. | |
| 5,594,303 | A | 1/1997 | Simpson et al. | |
| 5,688,064 | A | 11/1997 | Shanks | |
| 5,733,511 | A | 3/1998 | De Francesco | |
| 5,846,883 | A | 12/1998 | Moslehi | |
| 6,259,209 | B1 | 7/2001 | Bhardwaj et al. | |
| 6,451,161 | B1 | 9/2002 | Jeng et al. | |
| 6,792,889 | B2 | 9/2004 | Nakano et al. | |
| 6,873,119 | B2 * | 3/2005 | Kim | H01J 65/044 313/637 |
| 7,090,705 | B2 | 8/2006 | Miyazaki et al. | |
| 7,183,716 | B2 | 2/2007 | Kanarov et al. | |
| 7,886,690 | B2 | 2/2011 | Ellingboe | |
| 7,952,048 | B2 | 5/2011 | Choi et al. | |
| 8,018,163 | B2 | 9/2011 | Wi | |
| 8,128,884 | B2 | 3/2012 | Min et al. | |
| 8,169,148 | B2 | 5/2012 | Jeon et al. | |
| 8,636,871 | B2 | 1/2014 | Sawada et al. | |
| 9,066,413 | B2 | 6/2015 | Chang et al. | |
| 2003/0015965 | A1 | 1/2003 | Godyak | |
| 2004/0239261 | A1 | 12/2004 | Kim et al. | |
| 2005/0001556 | A1 | 1/2005 | Hoffman et al. | |
| 2009/0233385 | A1 | 9/2009 | Okumura et al. | |
| 2010/0015357 | A1 | 1/2010 | Hanawa et al. | |
| 2012/0031559 | A1 | 2/2012 | Dhindsa et al. | |
| 2013/0255575 | A1 | 10/2013 | Chang | |
| 2014/0077700 | A1 | 3/2014 | Chang et al. | |
| 2014/0130980 | A1 | 5/2014 | Lee et al. | |
| 2014/0292193 | A1 | 10/2014 | Chang | |
| 2014/0320016 | A1 | 10/2014 | Chang | |
| 2014/0370715 | A1 | 12/2014 | Chung | |

FOREIGN PATENT DOCUMENTS

| | | | |
|---|---|---|---|
| CN | 101194338 | B | 9/2010 |
| CN | 101601125 | B | 7/2012 |
| CN | 101534930 | B | 2/2013 |
| CN | 101420816 | B | 5/2014 |
| EP | 2120514 | B1 | 6/2012 |
| JP | H06122983 | A | 5/1994 |
| JP | H088096 | A | 1/1996 |
| JP | H09192479 | A | 7/1997 |
| JP | H11154600 | A | 6/1999 |
| JP | 2000/277506 | A | 10/2000 |
| JP | 2000/277599 | A | 10/2000 |
| JP | 2002/025919 | | 1/2002 |
| JP | 2003/529216 | A | 9/2003 |
| JP | 2005/259836 | A | 9/2005 |
| JP | 2006/310883 | A | 11/2006 |
| JP | 2008/181737 | A | 8/2008 |
| JP | 2010/132950 | A | 6/2010 |
| JP | 4601104 | B2 | 10/2010 |
| KR | 10 2001/0040736 | A | 5/2001 |
| KR | 10 2001/0093439 | A | 10/2001 |
| KR | 10 2004/0034758 | A | 4/2004 |
| KR | 10 2005/0092277 | A | 9/2005 |
| KR | 10 2005/0110548 | A | 11/2005 |
| KR | 10 2007/0062708 | A | 6/2007 |
| KR | 10 0761687 | B1 | 9/2007 |
| KR | 10 2008/0061814 | A | 7/2008 |
| KR | 10 2009/0005542 | A | 1/2009 |
| KR | 10 2009/0125406 | A | 7/2009 |
| KR | 10 2009/0108730 | A | 10/2009 |
| KR | 10 2010/0002290 | A | 6/2010 |
| KR | 10 2010/0066994 | | 6/2010 |
| KR | 10 2010/0087266 | A | 8/2010 |
| KR | 10 2011/0025328 | A | 10/2011 |
| KR | 10 1362891 | B1 | 2/2014 |
| WO | WO 92/08240 | A1 | 5/1992 |
| WO | WO 93/21655 | A1 | 10/1993 |
| WO | WO 94/08439 | A1 | 4/1994 |
| WO | WO 95/10848 | A1 | 4/1995 |
| WO | WO 96/28840 | A1 | 9/1996 |
| WO | WO 96/33509 | A1 | 10/1996 |
| WO | WO 97/02589 | A1 | 1/1997 |
| WO | WO 97/27609 | A1 | 7/1997 |
| WO | WO 98/53474 | A2 | 11/1998 |
| WO | WO 2012/077843 | A1 | 6/2012 |
| WO | WO 2012/157844 | A1 | 11/2012 |
| WO | WO 2013/018998 | A1 | 2/2013 |
| WO | WO 2013/055056 | A1 | 4/2013 |
| WO | WO 2014/003333 | A1 | 1/2014 |

OTHER PUBLICATIONS

Francis F Chen and Humberto Torreblanca, "Large-area helicon plasma source with permanent magnets", Plasma Physics and Controlled Fusion, vol. 49, A81-A93, Mar. 27, 2007.

International Search Report for PCT/KR2010/008798 dated Aug. 22, 2011.

International Search Report for Application No. PCT/KR2012/002179 dated Oct. 4, 2012.

International Search Report for Application No. PCT/KR2012/005525 dated Jan. 3, 2013.

Publication and International Search Report for Application No. 10-2011-0104792 2011 dated Apr. 18, 2013.

International Search Report for Application No. PCT/KR 2013/005072 dated Sep. 17, 2013.

Non-Final Office Action for U.S. Appl. No. 14/082,795 dated Oct. 24, 2014.

Notice of Allowance for U.S. Appl. No. 14/082,795 dated Feb. 20, 2015.

Chinese Office Action for Application No. CN 2010-80070565.7 dated Mar. 25, 2015.

Restriction Requirement for U.S. Appl. No. 14/472,781 dated Aug. 14, 2015.

* cited by examiner

MICROWAVE PLASMA LAMP WITH ROTATING FIELD

CROSS-REFERENCE TO RELATED APPLICATION

This application is a continuation of and claims priority to PCT/KR2013/005072 filed on Jun. 10, 2013, which claims priority to Korea Patent Application No. 10-2012-0070746 filed on Jun. 29, 2012, the entirety of which is hereby incorporated by reference.

BACKGROUND

1. Field of the Invention

The present invention relates to microwaves plasma lamp apparatuses and, more particularly, to a microwaves lamp apparatus that independently performs impedance matching and generates elliptically polarized microwaves.

2. Description of the Related Art

Since a conventional high intensity discharge (HID) lamp uses electrodes, its lifetime is limited to a few thousand hours. The end-of-life behaviors of the conventional HID lamp include a rapid decrease in the light flux. Moreover, since the conventional HID lamps use mercury that is one of the hazardous materials for the environment.

High-power microwaves HID lamps have emerged to overcome the foregoing disadvantages. A conventional high-power microwave discharge lamp that was disclosed to circumvent the above-mentioned problems uses a cylindrical waveguide in which a TE11 mode is excited, which is the lowest fundamental mode in a cylindrical waveguide. Accordingly, a spherical bulb is inserted in the cylindrical waveguide, and the shape of the plasma in the bulb is formed according to the pattern of the electric field lines in the TE11 mode. Since the electric field lines in the TE11 mode is almost linear, the plasma discharges are formed in an oval shape in the bulb. Thus, in case of high-power discharges, the hot plasma may cause local heating in the spherical bulb and the spherical bulb may be easily punctured due to the local heating.

In order to overcome the puncture caused by local heating, the bulb is rotated using a mechanical motor in the prior art lamps. This is not a desirable feature for any lamp. Another method has been proposed to rotate the electric field applied to the spherical lamp, facilitating the generation of uniform plasma discharges in a stationary bulb.

SUMMARY

The embodiments of the present invention provide a compact electrodeless microwaves plasma lamp which prevents the puncture of the bulb and which has a simple mechanical structure.

A microwave discharge lamp apparatus according to an embodiment of the present invention may include a rectangular waveguide having a rectangular shape one end of which is closed and the other end is open and receiving a microwave through an opening to put out linearly polarized microwaves; a discharge lamp; a resonator cavity, formed in a cylindrical shape, one end of which is open, which is disposed to surround the discharge lamp, and which is made of a conductive mesh, thereby allowing the passage of the light from the discharge lamp; and a phase shifter, which has a cross-shaped waveguide opened in a propagation direction of the linearly polarized microwaves, is disposed between the other end of the rectangular waveguide and one end of the resonator cavity, and receives the linearly polarized microwaves from the rectangular waveguide to generate elliptically polarized microwaves in the cylindrical resonator cavity. The elliptically polarized microwaves discharge the discharge lamp.

In an exemplary embodiment, the microwave discharge lamp apparatus may further include an impedance matching unit disposed between the phase shifter and the other end of the rectangular waveguide.

In an exemplary embodiment, the microwave discharge lamp apparatus may further include a connecting part which is disposed between the phase shifter and one end of the cylindrical resonator cavity to fix the cylindrical resonator cavity and has a cylindrical waveguide structure.

In an exemplary embodiment, the cross-shaped waveguide may be formed by a first waveguide of oval shape and a second waveguide also of oval shape, intersecting each other. The first waveguide may be longer than the second waveguide in their cross-sectional dimensions.

In an exemplary embodiment, the cross-shaped waveguide may include a first waveguide and a second waveguide intersecting each other, and the first waveguide and the second waveguide may meet at right angles.

In an exemplary embodiment, the impedance matching unit may have an input port to receive the linearly polarized microwaves and an output port to put out the linearly polarized microwaves, and the input and output ports may be formed on both surfaces perpendicular to the propagation direction of the linearly polarized microwaves.

In an exemplary embodiment, the impedance matching unit may have an input port to receive the linearly polarized microwaves and an output port to put out the linearly polarized microwaves, the input port may be formed on a surface perpendicular to the propagation direction of the linearly polarized microwaves, and the output port may be formed on a side surface defined by a major-axis direction of the rectangular waveguide and the propagation direction of the linearly polarized microwaves.

In an exemplary embodiment, the impedance matching unit may include a pair of stubs extending in the minor-axis direction of the rectangular waveguide, and the pair of stubs may be disposed to face each other on both side surfaces defined by the propagation direction of the linearly polarized microwaves and the minor-axis direction of the rectangular waveguide.

In an exemplary embodiment, the impedance matching unit may include a pair of recessed portions extending in the minor-axis direction of the rectangular waveguide, and the pair of recessed portions may be disposed to face each other on both side surfaces defined by the propagation direction of the linearly polarized microwaves and the minor-axis direction of the rectangular waveguide.

In an exemplary embodiment, the impedance matching unit and the rectangular waveguide may be integrally provided.

In an exemplary embodiment, the inside of the cross-shaped waveguide of the phase shifter may be filled with a dielectric material.

In an exemplary embodiment, the cross-shaped waveguide may include a first waveguide and a second waveguide intersecting each other, and the microwave discharge lamp apparatus may further include a dielectric plate disposed within the first waveguide.

A microwave discharge lamp apparatus according to another embodiment of the present invention may include a rectangular waveguide which receives microwaves through an opening and one end of which is closed and the other end is open; a discharge lamp; a cylindrical resonator cavity, one end of which is open, which is disposed to surround the discharge lamp, and which transmits the light from the discharge lamp to the outside; and a phase shifter, which has a cross-shaped waveguide opened in a propagation direction of the microwaves, and is disposed between the other end of the rectangular waveguide and the cylindrical resonator cavity. The microwaves propagate in the rectangular waveguide, the phase shifter, and the cylindrical resonator cavity to discharge the discharge lamp.

BRIEF DESCRIPTION OF THE DRAWINGS

The present invention will become more apparent in view of the attached drawings and accompanying detailed descriptions. The embodiments depicted therein are provided by way of example, not by way of limitation, wherein like reference numerals refer to the same or similar elements. The drawings are not necessarily to scale, with an emphasis instead being placed upon illustrating aspects of the present invention.

DETAILED DESCRIPTION

Figure 1:
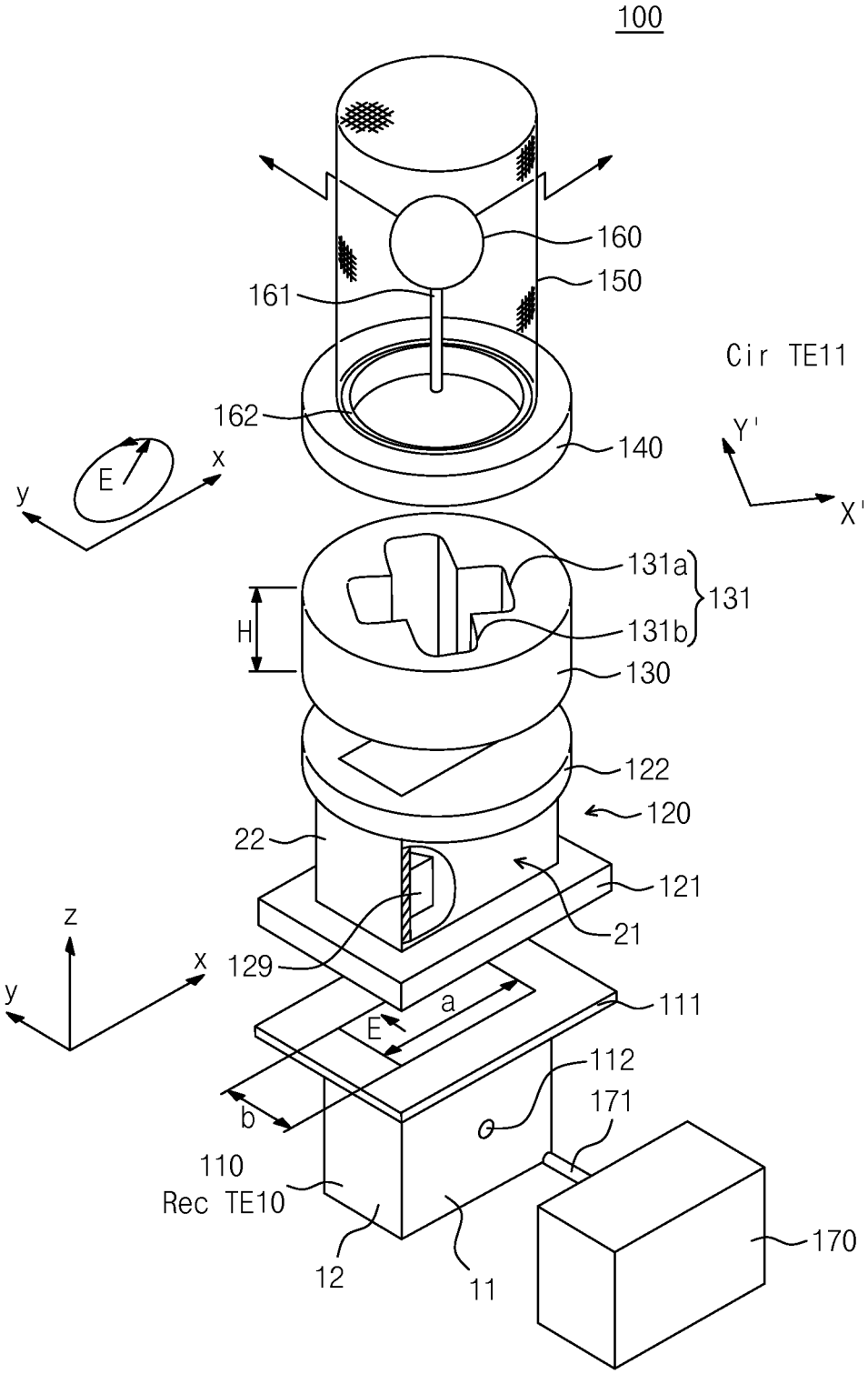
FIG. 1 is an exploded perspective view of a microwave discharge lamp apparatus according to an embodiment of the present invention.

A method of rotating a spherical lamp requires a mechanical motor to rotate a spherical bulb itself in a plasma lamp. The method of mechanically rotating a spherical lamp suffers from disadvantages such as the shortening of the lifetime of components, punctures of a bulb when the lamp rotation is stopped, a structural complexity caused by the use of additional components, and increased costs.

A method of generating circularly or elliptically polarized microwaves is disclosed herein to rotate the electric field applied to the stationary spherical lamp at a fixed position depending on time. In accordance with this method, a cross shaped waveguide is made of two waveguides of oval shape. Those two waveguides are recombined along the waveguide axes. The major axes of the cross sections of the two waveguides are of different length such that the phase velocities of the microwaves propagating along the two waveguides are different such that the combined waves at the output port will have a 90 degree phase difference and elliptically or circularly polarized microwaves are generated at the output port. Thus, since the structure is complicated and the external shape is enlarged, there is a problem in commercialization of the method.

Another method of generating circularly or elliptically polarized microwaves is disclosed herein to rotate the electric field applied to the spherical lamp at a fixed position depending on time. According to this method, a quarter-wave dielectric plate is inserted into a cylindrical waveguide to generate circularly or elliptically polarized microwaves. The quarter-wave dielectric plate separates the microwaves with a dielectric substance in two directions to make their phase speeds different for two perpendicular components of the electric field and thus provides a phase difference at the output port. However, the dielectric substance is limited in dielectric constant and increases in length to increase its volume.

Another method of generating elliptically or circularly polarized microwaves is disclosed herein to rotate an electric field applied to the spherical lamp at a fixed position depending on time. According to this method, an elliptical waveguide including a matching stub is provided between a rectangular waveguide and a cylindrical waveguide to generate circularly or elliptically polarized microwaves. However, the elliptical waveguide must have a sufficient length to achieve the effect. Moreover, as the impedance matching and the generation of circularly polarized microwaves are performed at the same time, it is difficult to satisfy the two conditions simultaneously. In particular, the elliptical waveguide must have a different structure depending on the type of bulb (load).

In order to overcome the disadvantages of prior art techniques mentioned above, the present invention uses a phase shifter having a cross-shaped section formed by intersecting two rectangular waveguides.

The phase shifter may easily generate elliptically polarized microwaves by receiving linearly polarized microwaves. The phase shifter may improve the accuracy of the eccentricity of the generated elliptically polarized microwaves. The phase shifter may enable shortening the length of a waveguide, as compared to the methods in the prior art. In addition, a stub required for impedance matching is formed independently of the phase shifter to enable independently impedance matching of a resonator cavity that includes a discharge lamp. Thus, the stub may independently enable impedance matching without having an influence on the eccentricity of the generated elliptically polarized microwaves. In addition, if a medium inserted into the phase shifter is a dielectric material having a high dielectric constant, the phase shifter may be decreased in length and size.

The present invention will now be described more fully hereinafter with reference to the accompanying drawings, in which preferred embodiments of the present invention are shown. However, the present invention may be embodied in many different forms and should not be construed as limited to the embodiments set forth herein. Rather, these embodiments are provided so that this disclosure will be thorough and complete, and will fully convey the scope of the present invention to those skilled in the art. Like numbers refer to like elements throughout.

Figure 2:
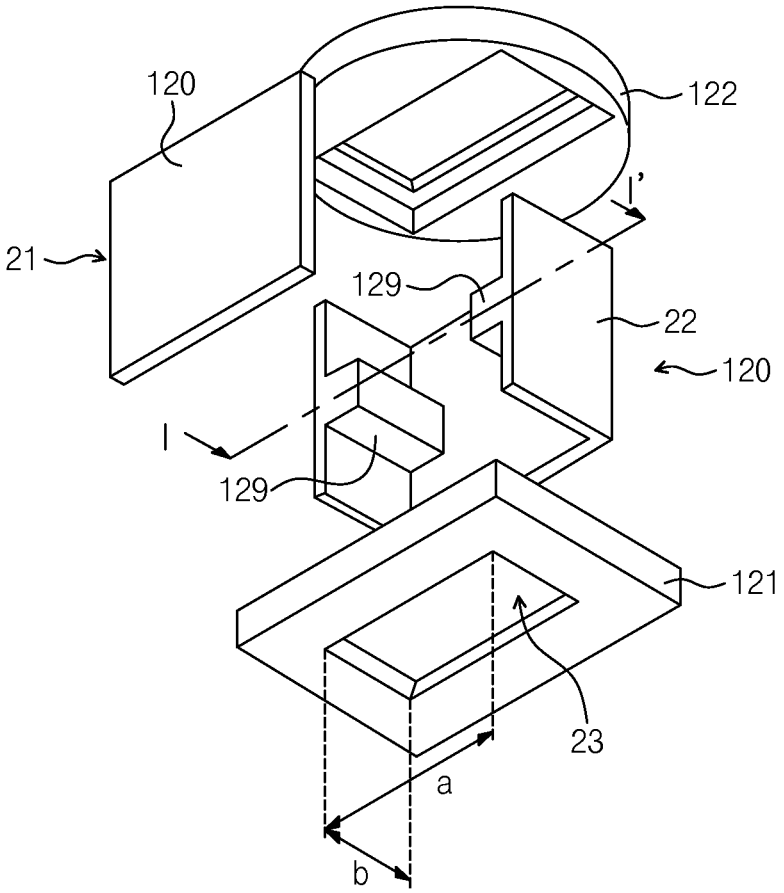
FIG. 2 is an exploded perspective view of an impedance matching unit of the microwave discharge lamp apparatus in FIG. 1.
Figure 3:
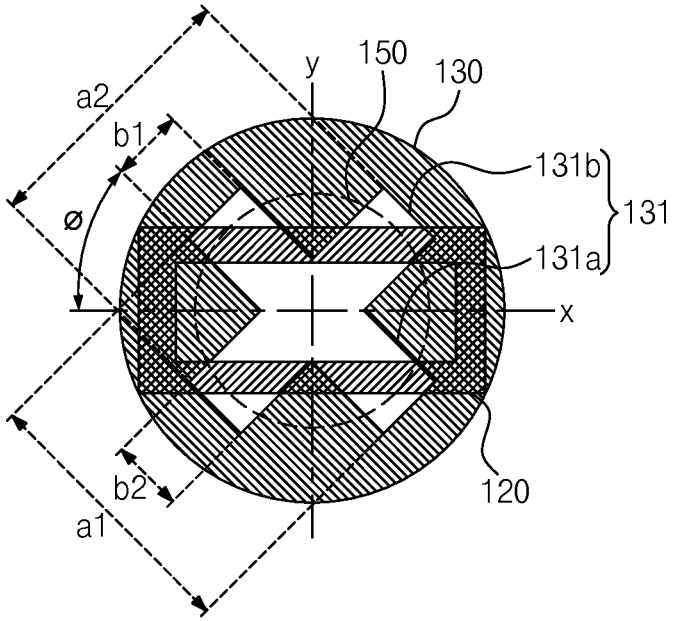
FIG. 3 is a top view of the microwave discharge lamp apparatus in FIG. 1.

FIG. 1 is an exploded perspective view of a microwave discharge lamp apparatus according to an embodiment of the present invention. FIG. 2 is an exploded perspective view of an impedance matching unit of the microwave discharge lamp apparatus in FIG. 1, and FIG. 3 is a top view of the microwave discharge lamp apparatus in FIG. 1. FIG. 4 is a perspective view of a discharge lamp of the microwave discharge lamp apparatus in FIG. 1.

Referring to FIGS. 1 to 3, a microwave discharge lamp apparatus 100 includes a rectangular waveguide 110, a discharge lamp 160, a resonator cavity 150, and a phase shifter 130. One end of the rectangular waveguide 110 is closed and the other end thereof is open, and the rectangular waveguide 110 has a rectangular shape and receives microwaves through an opening 112 to put out linearly polarized microwaves. One end of the resonator cavity 150 is open, and the resonator cavity 150 is disposed to surround the discharge lamp 160. The resonator cavity 150 is made of a conductive mesh to allow visible light from the discharge lamp 160 to pass through to the outside and has a cylindrical shape. The phase shifter 130 includes a cross-shaped waveguide 131 that penetrates the phase shifter 130 in the propagation direction of the linearly polarized microwaves. The phase shifter 130 is disposed between the other end of the rectangular waveguide 110 and one end of the resonator cavity 150 and receives the linearly polarized microwaves from the rectangular waveguide 110 to transmit elliptically polarized microwaves into the resonator 150. The elliptically or circularly-polarized microwaves discharge the discharge lamp 160, and the discharged plasma uniformly heats the inner wall of the discharge lamp 160 along the electric field. Thus, the lifetime of the microwave discharge lamp apparatus 100 is substantially prolonged. In addition, the phase shifter 130 has a short length. Furthermore, since the microwave discharge lamp apparatus 100 does not require other structures, space utilization is maximized.

The rectangular waveguide 110 has a rectangular cross sectional area, and a section of the rectangular waveguide 110 has a major axis of first direction (major-axis direction) and a minor axis of second direction (minor-axis direction). The rectangular waveguide 110 has a rectangular cross sectional area having a major-axis length a and a minor-axis length b. The rectangular waveguide 110 may extend in a third direction (z-axis direction or propagation direction) perpendicular to the plane defined by the first direction and the second direction. One end of the rectangular waveguide 110 is closed by a conductor plate, and the other end thereof is open in the third direction. Microwaves of the rectangular waveguide 110 may propagate in the third direction. The rectangular waveguide 110 may be made of a material with excellent conductivity such as aluminum (Al). The rectangular waveguide 110 may be of WR340 type. The rectangular waveguide 110 may include a flange 111 to be coupled with another component.

The rectangular waveguide 110 may have an opening formed at a first side surface 11 defined by the major-axis direction and the propagation direction. An antenna 171 inserted into the opening 112 may generate microwaves. One end of the rectangular waveguide 110 is closed by a conductor plate, and the other end thereof is open. Thus, the microwaves of the rectangular waveguide 110 may propagate through the open end of the rectangular waveguide 110.

A microwave generator 170 may be a magnetron, and a frequency of the microwave generator 170 may be in the ISM band including 2.45 GHz. The antenna 171 of the microwave generator 170 may radiate microwaves into the rectangular waveguide 110 through the opening 112.

Microwaves or electromagnetic waves provided to the rectangular waveguide 110 may have a predetermined mode due to the geometric structure of the rectangular waveguide 110. A mode set up in the rectangular waveguide 110 may include a TM mode and a TE mode. A mode in which a cutoff frequency is the lowest is a TE10 mode. Accordingly, the mode propagating in the rectangular waveguide 110 may be the TE10 mode. The rectangular waveguide 110 may be designed such that only the TE10 mode may propagate in the rectangular waveguide 110. Thus, an electric field E of the TE10 mode oscillates only in the minor-axis direction (y-axis direction).

The linearly polarized microwaves may be applied to even a case where an electric field oscillates only in a specific direction in a waveguide. For example, since the TE10 mode propagates in the rectangular waveguide 110, the TE10 mode may be linearly polarized.

The rectangular waveguide 110 may be connected to an impedance matching unit 120. The impedance matching unit 120 is means for transferring maximum power in the direction where a load (discharge lamp) is viewed from the impedance matching unit 120. One end of the impedance matching unit 120 may have a rectangular flange 121, and the other end thereof may have a circular flange 122.

The forward power supplied by the rectangular waveguide 110 returns to the rectangular waveguide 110 after being reflected by the load (discharge lamp) or the resonator cavity 150. Thus, the reflected power or reflected microwaves may exist in the rectangular waveguide 110. In this case, the impedance matching unit 120 re-reflects the reflected power or the reflection microwaves in a load or resonator direction to transfer the maximum power to the resonator cavity 150 or the load. Thus, the microwave generator 170 may stably operate without being damaged by the reflected power and the wasted power may be reduced.

The impedance matching unit 120 may have the same cross sectional structure as the rectangular waveguide 110. That is, the impedance matching unit 120 and the rectangular waveguide 110 may have the same characteristic impedance defined by a geometric structure. Thus, an impedance matching problem between the impedance matching unit 120 and the rectangular waveguide 110 may be resolved. A rectangular flange having a rectangular opening may be disposed at one end of the impedance matching unit 120, and a circular flange having a circular opening may be disposed at the other end of the impedance matching unit 120.

The impedance matching unit 120 may enable impedance matching using a stub 129. The stub 129 used to perform impedance matching may have a screw shape, a post shape, or the like. Stubs 129 may have a polygonal pillar shape and be symmetrically disposed on an inner surface of the impedance matching unit 120.

For example, the stub 129 may have a square pillar shape and be disposed in the minor-axis direction on a second surface 22 defined by the minor-axis direction and the propagation direction. A pair of stubs 129 may be provided and disposed in the minor-axis direction in contact with the second surface 22 to face each other. The length of the stub 129 may be equal to the length b of the minor-axis direction. The impedance matching unit 120 may be modified into a straight shape, an L-shape or an oblique shape.

According to a modified embodiment of the present invention, the stub 129 of the impedance matching unit 120 may be mounted on the rectangular waveguide 110. That is, the impedance matching 120 and the rectangular waveguide 110 may be integrally provided.

The impedance matching unit 120 may be connected to the phase shifter 130. The phase shifter 130 may have a cylindrical appearance and include a cross-shaped waveguide 131 formed therein. The phase shifter 130 may change the phase for each component of the microwaves by receiving linearly polarized microwaves in the TE10 mode as an input. The phase shifter 130 includes a cross-shaped waveguide 131. The waveguide 131 may penetrate the phase shifter 130 with a predetermined length. The phase shifter 130 may be made of a cylindrical conductor. The phase shifter 130 may be modified into various shapes as long as it has a cross-shaped waveguide.

The cross-shaped waveguide 131 includes a first waveguide 131*a* and a second waveguide 131*b* intersecting the first waveguide 131*a* in crossed form. The cross sectional area of the first waveguide 131*a* has length a1 and width b1 and the second waveguide 131*b* has length a2 and width b2. The cross-shaped waveguide 131 has depth H. An angle formed by the extension direction (X' direction) of the first waveguide 131*a* and the major axis (x direction) of the rectangular waveguide (or impedance matching unit) may be about 30 to about 70 degrees.

The angle formed between the first waveguide 131*a* and the major axis of the rectangular waveguide (or impedance matching unit), the shape of the cross-shaped waveguide 131, and the depth H of the cross-shaped waveguide 131 may be obtained by computer simulation. The depth H of the cross-shaped waveguide 131 required to convert linearly polarized microwaves into elliptically polarized microwaves may be smaller than a quarter of microwave wavelength. Thus, the length of a waveguide may decrease, as compared to a case where a quarter-wave dielectric plate is inserted. According to a conventional method, an additional circular waveguide is required to insert the quarter-wave dielectric plate. However, the phase shifter 130 according to the present invention does not require an additional circular waveguide. In addition, the phase shifter 130 operates in the same manner with respect to a reflection microwave to convert circularly polarized microwaves into linearly polarized microwaves.

In the rectangular waveguide TE10 mode propagating in the rectangular waveguide 110 and the impedance matching unit 120, an electric field E is established in a minor-axis direction. The electric field E may be provided to an input port of the phase shifter 130 and divided into a first component E1 in the direction alongside of the first waveguide 131*a* and a second component E2 in the direction alongside of the second waveguide 131*b*. The first component E1 and the second component E2 may have a phase difference of 90 degrees after having propagated in the cross-shaped waveguide 131. Accordingly, the first component E1 and the second component E2 overlap at an output port of the phase shifter 130 to be provided to a connecting part 140 and the resonator cavity 150. Thus, microwaves propagating through the connecting part 140 and the resonator cavity 150 may have elliptical or circular polarization (E1+jE2), where j is the imaginary number, the square root of −1.

The connecting part 140 may be interposed between the phase shifter 130 and the resonator cavity 150 to fix the resonator cavity 150. The connecting part 140 may be in the form of washer having a circular through-hole. An inner diameter of the through-hole may be equal to that of the resonator cavity 150. A single TE11 mode may propagate in the connecting part 140.

A conventional cylindrical resonator cavity has both ends that are closed by a conductor to form a complete cavity. However, since one end of the resonator cavity 150 according to the present invention is open, the resonator cavity 150 does not form a complete resonator cavity. The resonator cavity 150 may be in the form of mesh to pass through visible light of a discharge lamp but to contain microwaves within the cavity. The resonator cavity 150 may be designed such that a single TE11 may propagate therein. The resonator cavity 150 may have various surface patterns such as a honeycombed shape, a structure with polygonal hole or a mesh-like shape. The resonator cavity 150 may be modified into various surface patterns as long as light passes therethrough the said surface while current flows in the surface of the resonator cavity 150.

The discharge lamp 160 is disposed in the center region of the resonator cavity 150. In the initial discharges when plasma is not generated at the discharge lamp 160 inside the resonator cavity 150, microwaves entering the resonator cavity 150 are reflected at the other end of the resonator cavity 150 closed by the conductor. Thus, a standing microwave may be set up in the resonator cavity 150. The standing microwave may provide an electric field required for the initial discharges.

When a plasma is generated at the discharge lamp 160 inside the resonator cavity, the microwaves entering the resonator cavity 150 are almost absorbed to the discharge lamp 160 significantly reducing the reflection of the microwaves.

The discharge lamp 160 may have a spherical shape or a cylindrical form. The discharge lamp 160 may be made of a transparent dielectric material. For example, the discharge lamp 160 may be made of quartz which is filled with a discharge fill material. The discharge lamp 160 may be disposed at a position in the center region inside the resonator cavity 150 where the magnitude of the electric field is a maximum. The discharge lamp 160 may be fixed by support means 161. For example, the support means 161 may be a dielectric rod connected to the discharge lamp 161. The dielectric rod may be connected to a support dielectric plate 162. The support dielectric plate 162 may be mounted on the connecting part 140. One end of the support dielectric plate 162 may be coated to reflect visible light of the discharge lamp 160.

The discharge fill material may include at least one of sulfur, selenium, mercury, and metal halide. The discharge fill material may further include buffer gas such as argon gas. A reflection structure (not shown) may be mounted around the resonator cavity 150 to provide directionality to light from the discharge lamp 160. The reflection structure may be a conic structure or a parabolic structure.

Figure 4A:
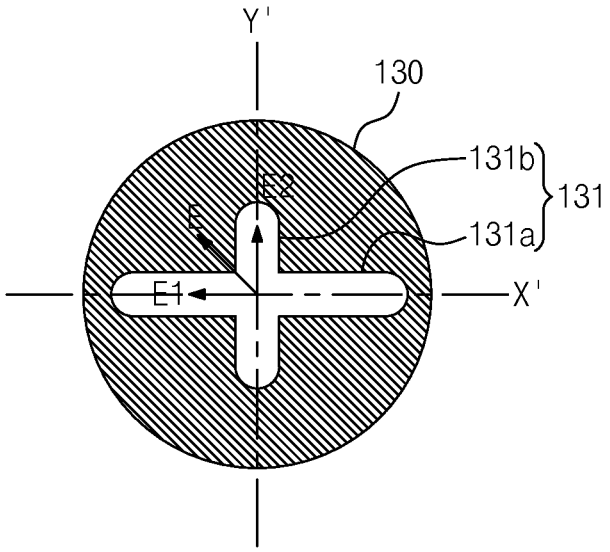
FIG. 4A is a cross-sectional view of a phase shifter according to an embodiment of the present invention.
Figure 4B:
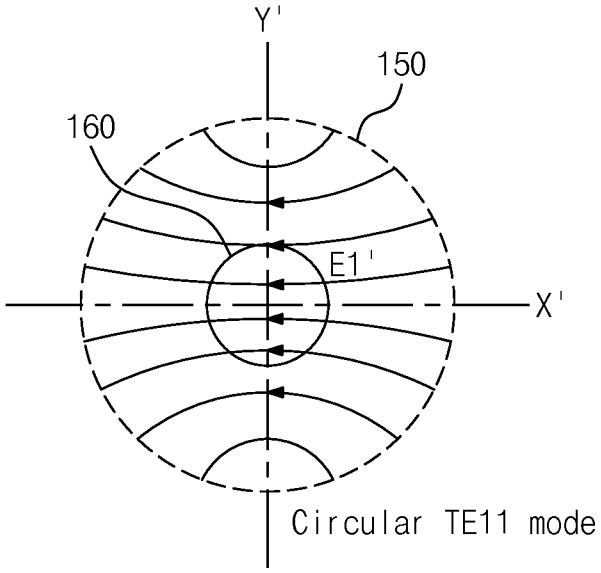
FIGS. 4B and 4C illustrate a pattern of the electric field established in a resonator cavity.
Figure 4C:
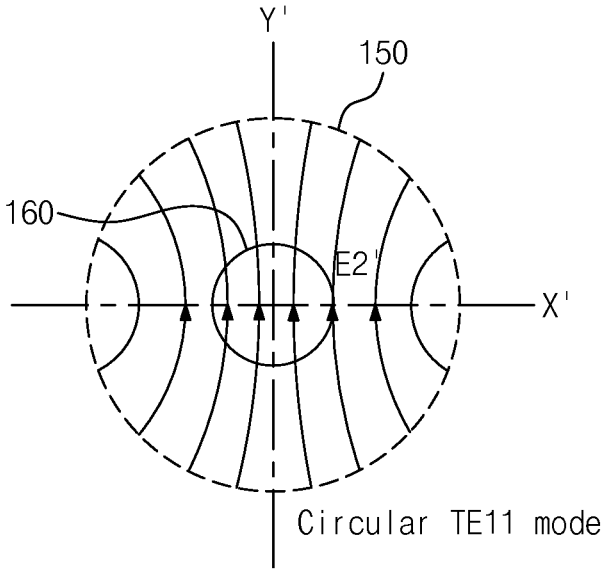

FIG. 4A is a cross-sectional view of a phase shifter according to an embodiment of the present invention, and FIGS. 4B and 4C illustrate electric field lines established at a resonator.

Referring to FIGS. 4A and 4C, a phase shifter 130 may provide different phases to a first electric field E1 and a second electric field E2. The first electric field E1 is disposed alongside of an X'-axis direction in which a first waveguide 131*a* extends, and the second electric field E2 is disposed alongside of a Y'-axis direction in which a second waveguide 131*b* extends. When the first electric field E1 and the second electric field E2 leave the phase shifter 130, a TE11 mode may be generated. Since a first electric field E1' and a second electric field E2' propagating into the resonator cavity 150 have a phase difference of 90 degrees, they may overlap each other to generate elliptically polarized microwaves. Thus, the overlapping electric fields may rotate around a discharge lamp in a fixed position according to time.

Figure 5A:
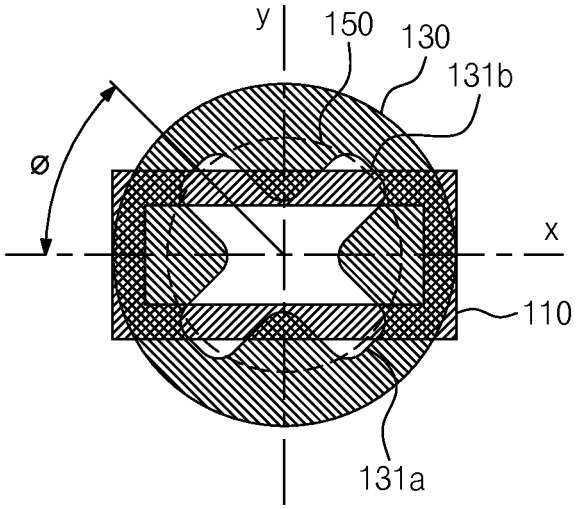
FIGS. 5A to 5C are cross-sectional views of the phase shifters according to an embodiment of the present invention, respectively.
Figure 5B:
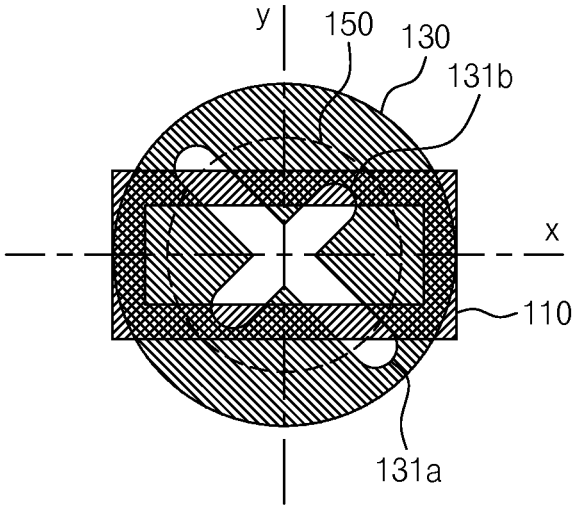
Figure 5C:
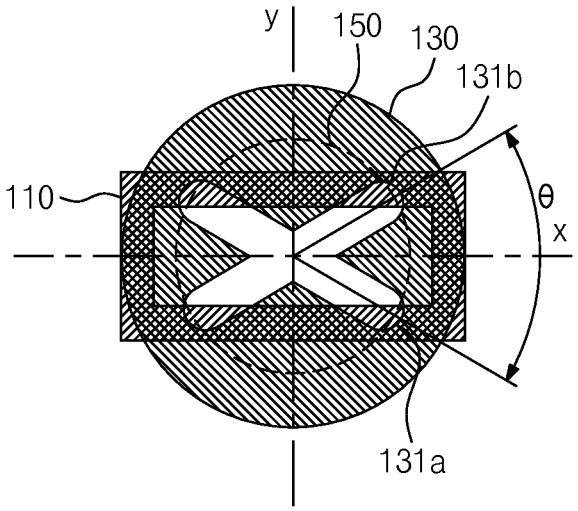

FIGS. 5A to 5C are cross-sectional views of phase shifters according to an embodiment of the present invention, respectively.

Referring to FIG. 5A, an angle between a major-axis direction of a rectangular waveguide 110 and an extension direction of a first waveguide 131*a* may be about 30 to 70 degrees. The length (major axis) of the longer side of the first waveguide 131*a* may be greater than the diameter of a resonator cavity 150. In addition, the length of the first major axis of the first waveguide 131*a* may be smaller than the major-axis length a of the rectangular waveguide 110. The first waveguide 131*a* and the second waveguide 131*b* may have the same structure and be disposed overlapping to meet at right angles to each other. The ends of the first waveguide 131*a* and the second waveguide 131*b* may be rounded. An overlap portion of the first waveguide 131*a* and the second waveguide 131*b* may be right-angled or rounded. The first waveguide 131*a* and the second waveguide 131*b* are not limited to a rectangular shape and may be modified into an elliptical shape with a large eccentricity.

Referring to FIG. 5B, the length of a first waveguide 131*a* may be greater than the diameter of a resonator cavity 150, and the length of a second waveguide 131*b* may be smaller than the diameter of the resonator cavity 150. The ends of the first waveguide 131*a* and the second waveguide 131*b* may be rounded.

Referring to FIG. 5C, a first waveguide 131*a* and a second waveguide 131*b* may have the same structure. The first waveguide 131*a* and the second waveguide 131*b* may be disposed overlapping while they do not meet at right angles to each other. The angle between the first waveguide 131*a* and the second waveguide 131*b* may be about 20 to about 90 degrees. Substantially, the generation of elliptically polarized microwaves is more advantageous when the first waveguide 131*a* and the second waveguide 131*b* are slightly tilted than when they meet at right angles to each other.

Figure 6A:
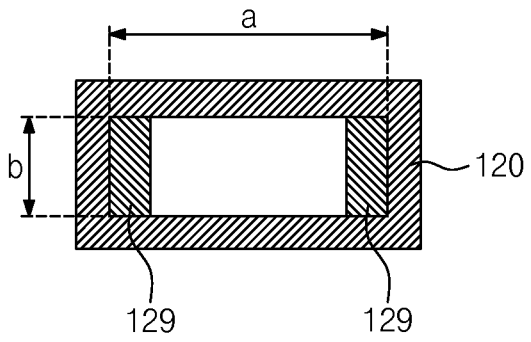
FIGS. 6A to 6C are cross-sectional views illustrating structures of a stub of an impedance matching unit, respectively.
Figure 6B:
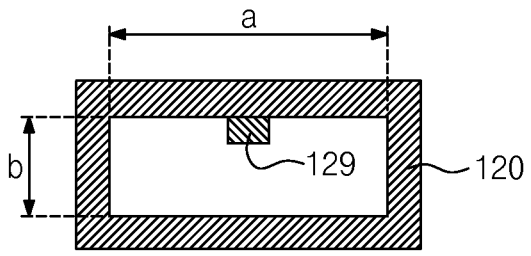
Figure 6C:
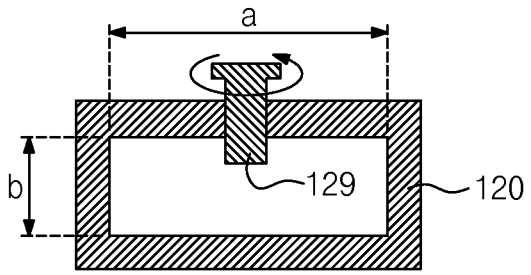

FIGS. 6A to 6C are cross-sectional views illustrating structures of a stub of an impedance matching unit, respectively.

Referring to FIG. 6A, a stub 129 may extend at both side surfaces defined by a minor-axis direction and a propagation direction of an impedance matching unit 120 in the minor-axis direction of the impedance matching unit 120. The length of the stub 129 may be equal to the minor-axis direction length b. The stub 129 may have a shape of polygonal pillar. The stub 129 may be modified into various shapes as long as it has a symmetry with respect to the impedance matching unit 120.

Referring to FIG. 6B, a stub 129 may be disposed on one plane or both planes defined by a major-axis direction and a propagation direction of an impedance matching unit 120. The stub 129 may be disposed in the center of a major axis on a plane defined by an internal major-axis direction and a propagation direction of the impedance matching unit 120. The stub 129 may have a shape of polygonal pillar. The length of the stub 129 may be smaller than that of a minor-axis.

Referring to FIG. 6C, a stub 129 may be disposed on one plane or both planes defined by a major-axis direction and a propagation direction of an impedance matching unit 120. The stub 129 may be disposed in the center of a major axis on a plane defined by an internal major-axis direction and a propagation direction of the impedance matching unit 120. The stub 129 may have a cylindrical male crew structure. With the rotation of the stub 129, the sub 129 may be inserted into the impedance matching unit 129.

Figure 7A:
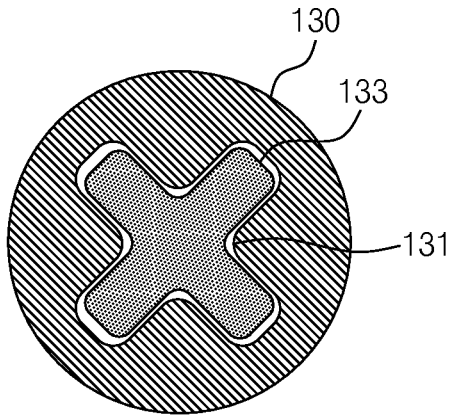
FIGS. 7A and 7B illustrate phase shifters according to other embodiments of the present invention, respectively.
Figure 7B:
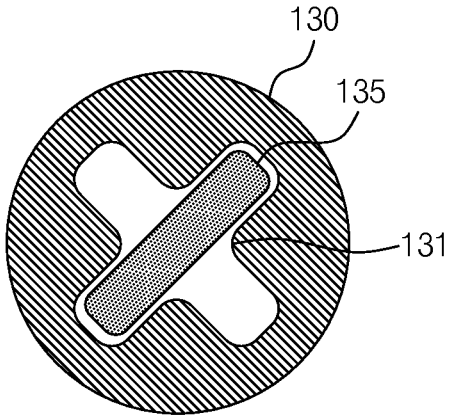

FIGS. 7A and 7B illustrate phase shifters according to other embodiments of the present invention, respectively.

Referring to FIG. 7A, a phase shifter 130 include a cross-shaped waveguide 131 formed therein. The inside of the waveguide 131 may be filled with a high-k dielectric material 133. The dielectric material 133 may be alumina or ceramic. Thus, the length H of the phase shifter 130 causing a phase difference of 90 degrees may significantly be decreased.

Referring to FIG. 7B, a phase shifter 130 include a cross-shaped waveguide 131 formed therein. A dielectric plate 135 may be inserted into the cross-shaped waveguides 131. The dielectric plate 135 may be alumina or ceramic. Thus, the length H of the phase shifter 130 causing a phase difference of 90 degrees may significantly be decreased.

FIGS. 8 to 11 are perspective views of microwave discharge lamp apparatuses according to other embodiments of the present invention, respectively. In FIGS. 8 to 11, sections different from FIG. 1 will be extensively described to avoid duplicate description.

Figure 8:
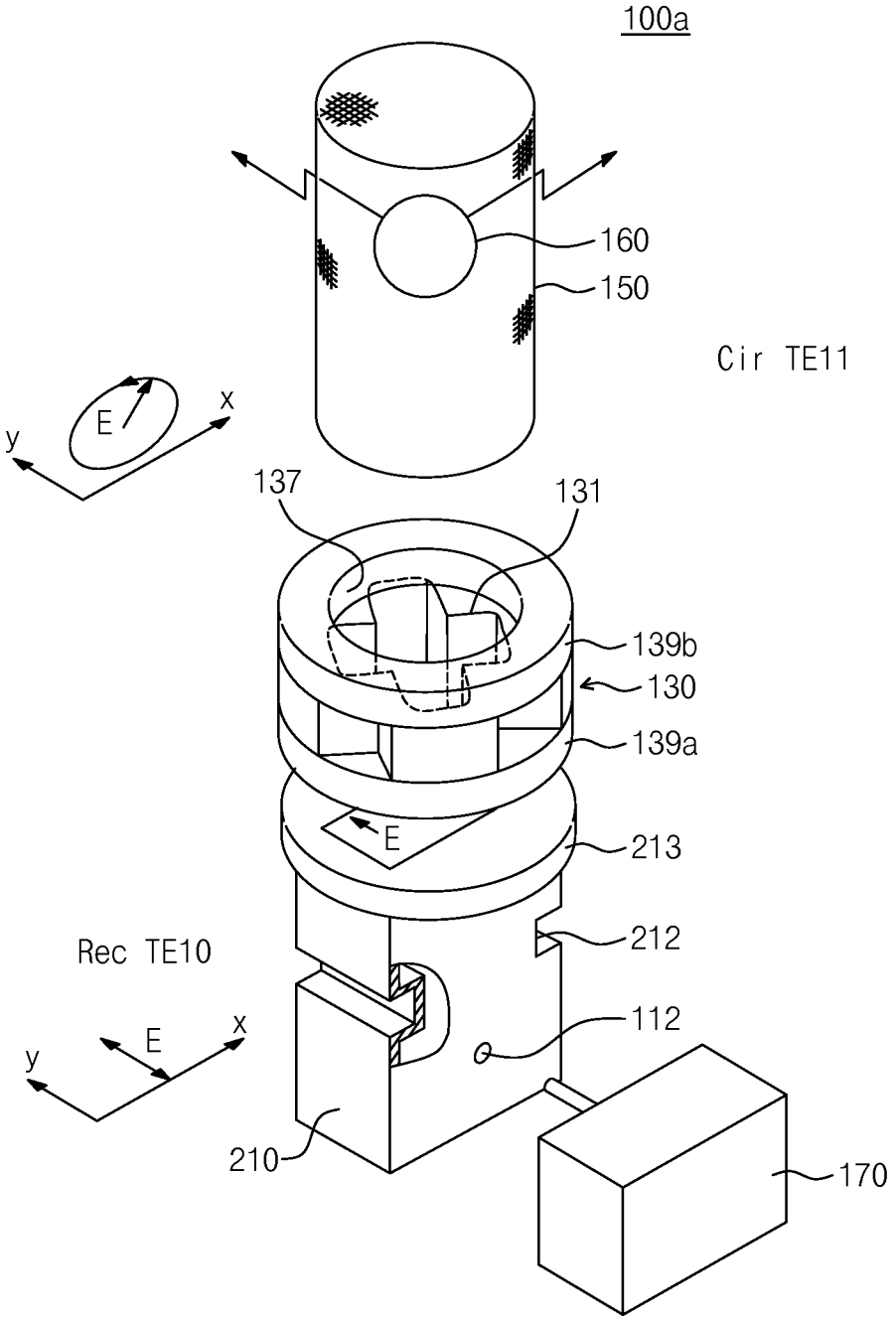
FIGS. 8 to 11 are perspective views of microwave discharge lamp apparatuses according to other embodiments of the present invention, respectively.

Referring to FIG. 8, a microwave discharge lamp apparatus 100*a* includes a rectangular waveguide 210 having a rectangular shape one end of which is closed and the other end is open and receiving microwaves through an opening 112 to put out linearly polarized microwaves, a discharge lamp 160, a resonator cavity 150 one end of which is open and which is disposed to surround the discharge lamp 160 and has a cylindrical shape made of a conductive mesh allowing visible light of the discharge lamp 160 to be transmitted to the outside, and a phase shifter 130 having a cross-shaped waveguide penetrating in a propagation direction of the linearly polarized microwaves, being disposed between the other end of the rectangular waveguide 210 and one end of the resonator cavity 150, and receiving the linearly polarized wave from the rectangular waveguide 210 to generate elliptically polarized microwaves in the cylindrical resonator cavity 150. The elliptically polarized microwaves discharge the discharge lamp 160.

A microwave generator 170 provides microwaves through the opening 112 formed at the rectangular waveguide 210 having a rectangular shape. The rectangular waveguide 210 is directly connected to the phase shifter 130. The rectangular waveguide 210 includes a recessed portion 212 recessed in a minor-axis direction. The recessed portion 212 may be formed by extending in the minor-axis direction on a first surface defined by the minor-axis direction and a propagation direction.

The recessed portion 212 performs the same function as a stub disposed inside a waveguide. That is, the rectangular waveguide 210 may be fabricated integrally with an impedance matching unit without being separated therefrom.

One end of the rectangular waveguide 210 is closed by a conductor plate, and the other end thereof is open. The other end of the rectangular waveguide 210 may have a disk-shaped flange to be coupled with the cylindrical phase shifter 130.

The phase shifter 130 may include a cross-shaped waveguide 131, and the shape of the phase shifter 130 may have the same shape as the waveguide 131 to reduce weight of the phase shifter 130. The phase shifter 130 may include an upper flange 139*b* to be coupled with the resonator cavity 150. An opening 137 of the upper flange 139*b* may have the same diameter as the resonator cavity 150.

The phase shifter 130 may include a lower flange 139*a* to be coupled with the other end of the rectangular waveguide 210. The cross-shaped waveguide 131 may extend to the lower flange 139*a*.

Figure 9:
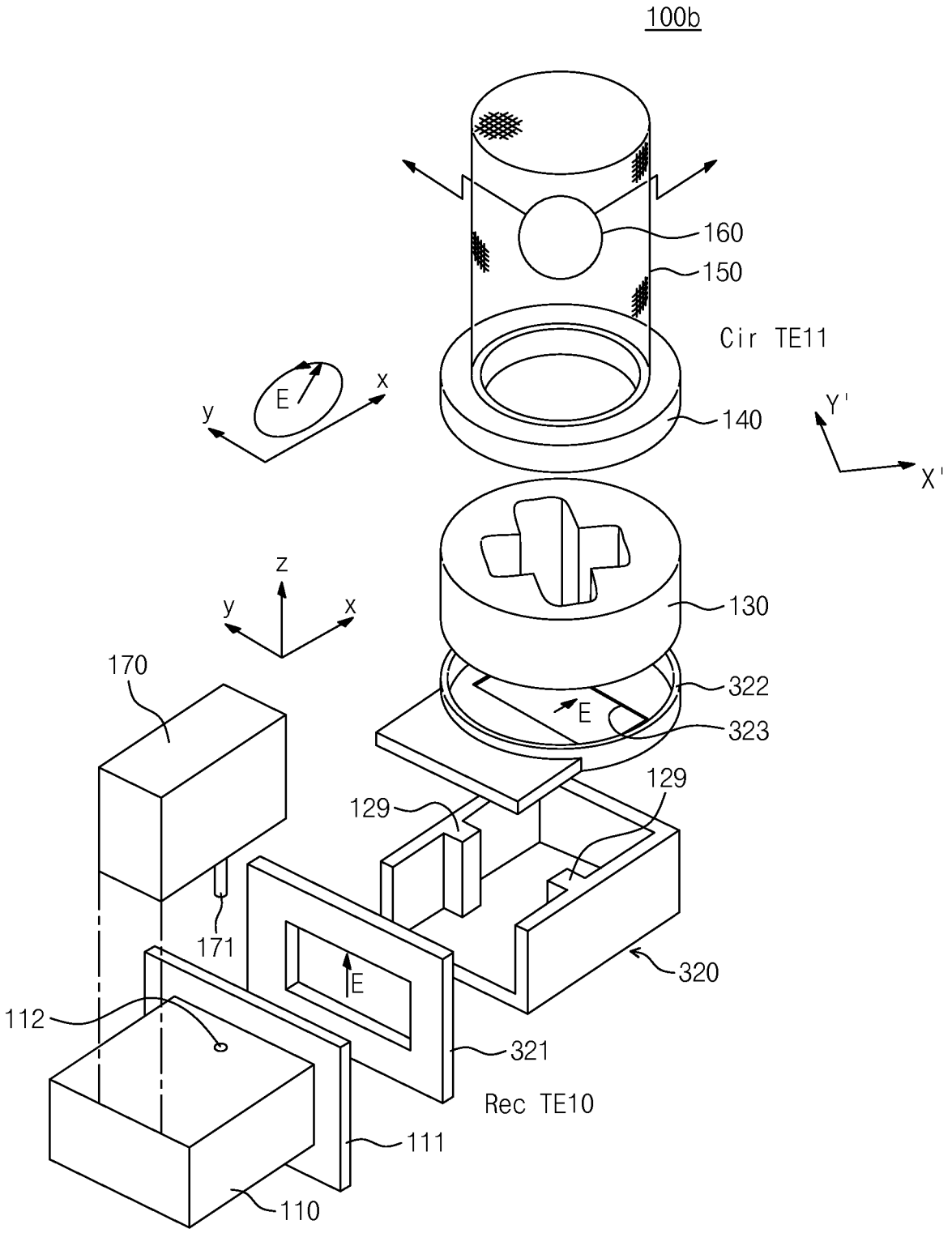

Referring to FIG. 9, a microwave discharge lamp apparatus 100*b* includes a rectangular waveguide 110 having a rectangular shape one end of which is closed and the other end is open and receiving microwaves through an opening 112 to put out linearly polarized microwaves, a discharge lamp 160, a resonator cavity 150 of which one end is open and which is disposed to surround the discharge lamp 160 and has a cylindrical shape made of a conductive mesh allowing visible light of the discharge lamp 160 to be transmitted to the outside, and a phase shifter 130 which has a cross-shaped waveguide penetrating in a propagation direction of the linearly polarized microwaves, is disposed between the other end of the rectangular waveguide 110 and one end of the resonator cavity 150, and receives the linearly polarized microwaves from the rectangular waveguide 110 to generate elliptically polarized microwaves in the cylindrical resonator cavity 150. The elliptically polarized microwaves discharge the discharge lamp 160.

An impedance matching unit 320 may have an L shape as a structure of a rectangular waveguide. The rectangular waveguide 110 may be a rectangular waveguide. The impedance matching unit 320 may have a sectional area with a first direction (major-axis direction or y-axis direction) and a second direction (minor-axis direction or z-axis direction). One end of the impedance matching unit 320 may be coupled with an open surface of the rectangular waveguide 110. The impedance matching unit 320 extends in a third direction (x-axis direction) in which microwaves propagate. The other end perpendicular to the first direction of the impedance matching unit 320 may be closed by a conductor plate. The impedance matching unit 320 may have a rectangular opening 323 on a first surface defined by the major-axis direction (y-axis direction) and the first direction (x-axis direction). The rectangular opening 323 may be formed such that a waveguide has a 90-degree L shape.

A cylindrical protrusion 322 may be disposed to surround the rectangular opening 323. The cylindrical protrusion 322 may be integrated with a top surface of the impedance matching unit 320. One end of the phase shifter 130 may be inserted into the cylindrical protrusion 322 to be fixed. Thus, one end of the phase shifter 130 may be in contact with the top surface of the impedance matching unit 320.

The impedance matching unit 320 may include a stub 129 for impedance matching therein. The stub 129 may be disposed while extending in the minor-axis direction on a second plane defined by a propagation direction (x-axis direction) and the minor-axis direction (z-axis direction). The stub 129 may have a shape of polygonal pillar. A pair of stubs 129 may be symmetrically disposed on both side surfaces of the impedance matching unit 320.

Figure 10:
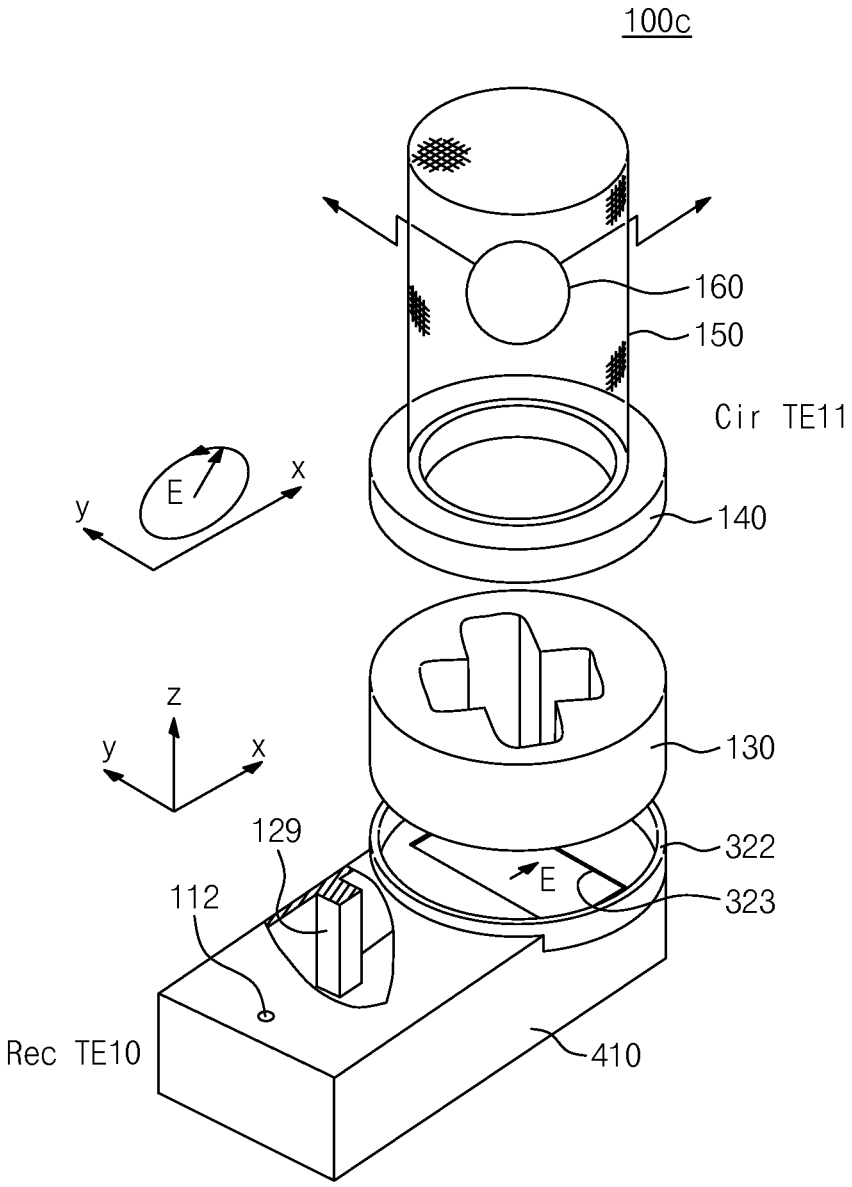

Referring to FIG. 10, a microwave discharge lamp apparatus 100*c* includes a rectangular waveguide 410 having a rectangular shape one end of which is closed and the other end is open and receiving microwaves through an opening 112 to put out linearly polarized microwaves, a discharge lamp 160, a resonator cavity 150 one end of which is open and which is disposed to surround the discharge lamp 160 and has a cylindrical shape made of a conductive mesh allowing visible light of the discharge lamp 160 to be transmitted to the outside, and a phase shifter 130 which has a cross-shaped waveguide penetrating in a propagation direction of the linearly polarized microwaves, is disposed between the other end of the rectangular waveguide 110 and one end of the resonator cavity 150, and receives the linearly polarized microwaves from the rectangular waveguide 410 to generate elliptically polarized microwaves in the cylindrical resonator cavity 150. The elliptically polarized microwaves discharge the discharge lamp 160.

The rectangular waveguide 110 and an impedance matching unit 320 in FIG. 9 may be integrally provided. The rectangular waveguide 410 may have a first direction (major-axis direction) and a second direction (minor-axis direction) and extend in a third direction (propagation direction). Both ends of the rectangular waveguide 410 may be closed by a conductor plate. The stub 129 may extend in the second direction (minor-axis direction) on an internal side surface defined by the third direction (propagation direction) and the second direction (minor-axis direction). A pair of stubs 129 may be symmetrically disposed on both side surfaces. A top surface of the rectangular waveguide 410 may have a rectangular opening 323. A cylindrical protrusion 322 may be disposed to surround the rectangular opening 323. The cylindrical protrusion 322 may be integrally coupled with the top surface of the rectangular waveguide 410.

Figure 11:
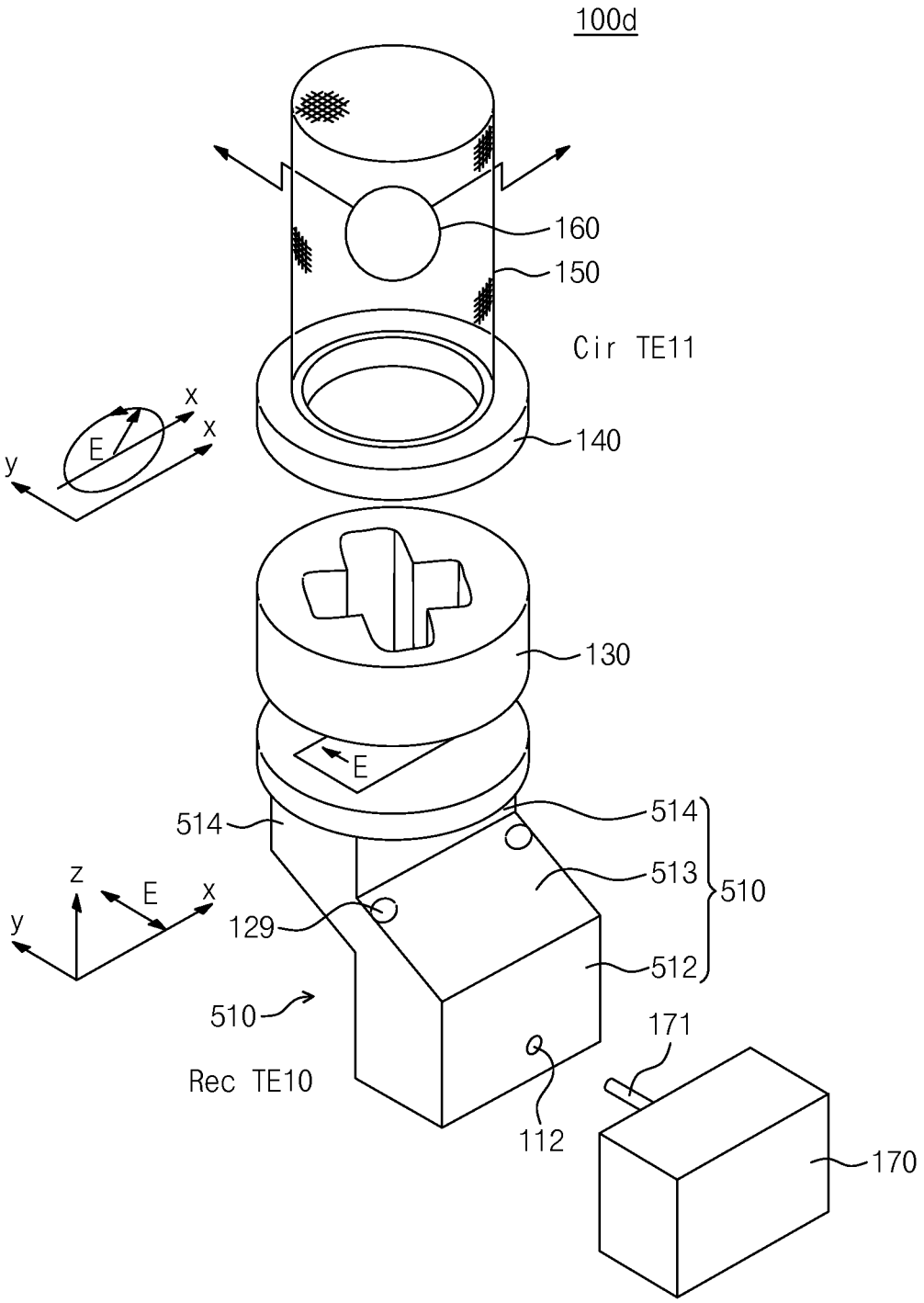

Referring to FIG. 11, a microwave discharge lamp apparatus 100*d* includes a rectangular waveguide 510 having a rectangular shape one end of which is closed and the other end is open and receiving microwaves through an opening 112 to output linearly polarized microwaves, a discharge lamp 160, a resonator cavity 150 of which one end is open and which is disposed to surround the discharge lamp 160 and has a cylindrical shape made of a conductive mesh allowing visible light of the discharge lamp 160 to be transmitted to the outside, and a phase shifter 130 which has a cross-shaped waveguide penetrating in a propagation direction of the linearly polarized microwaves, is disposed between the other end of the rectangular waveguide 510 and one end of the resonator cavity 150, and receives the linearly polarized microwaves from the rectangular waveguide 510 to generate elliptically polarized microwaves in the cylindrical resonator cavity 150. The elliptically polarized microwaves discharge the discharge lamp 160.

The rectangular waveguide 510 may include two straight portions 512 and 514 and an oblique portion 513 to connect the straight portions 512 and 514 to each other. The straight portions 512 and 514 may be spaced apart from each other in a minor-axis direction of the rectangular waveguide 510. The oblique portion 513 may connect the spaced straight portions 512 and 514 to each other. The oblique portion 513 may include a stub 129 for impedance matching. The stub 129 may penetrate the oblique portion 513 to be perpendicular to a plane defined by a propagation direction and a major-axis direction of the oblique portion 513. The stub 129 may have a cylindrical shape. The stub 129 may penetrate the oblique portion 513 at both edges of the major-axis direction. The rectangular waveguide 510 may include a first straight portion 512, an oblique portion 513, and a second straight portion 514 that are successively connected. One end of the rectangular waveguide 510 may be closed by a conductor plate. The other end of the rectangular waveguide 510 may have a rectangular opening. The rectangular opening may be formed at a disk-shaped flange. The disk-shaped flange may be coupled with the phase shifter 130.

According to an embodiment of the present invention, a microwave plasma lamp apparatus converts linearly polarized microwaves into elliptically polarized microwaves using a phase shifter having a cross-shaped waveguide and applies the elliptically polarized microwaves to a lighting lamp to prevent a puncture resulting from local heating of the lamp. In addition, an impedance matching unit can control impedance in the load direction independently of the phase shifter and provide stable elliptically polarized microwaves to various loads such as a discharge lamp with a simple structure.

Although the present invention has been described in connection with the embodiment of the present invention illustrated in the accompanying drawings, it is not limited thereto. It will be apparent to those skilled in the art that various substitutions, modifications and changes may be made without departing from the scope and spirit of the present invention.

What is claimed is:

1. A microwave discharge lamp apparatus which comprises:

a rectangular waveguide having a rectangular shape one end of which is closed and the other end is open and receiving a microwave through an opening to put out linearly polarized microwaves;

a discharge lamp;

a resonator cavity, formed in a cylindrical shape, one end of which is open, which is disposed to surround the discharge lamp, and which is made of a conductive mesh, thereby allowing the passage of the light from the discharge lamp; and a phase shifter, which has a cross-shaped waveguide opened in a propagation direction of the linearly polarized microwaves, is disposed between the other end of the rectangular waveguide and one end of the resonator cavity, and receives the linearly polarized microwaves from the rectangular waveguide to generate elliptically polarized microwaves in the cylindrical resonator cavity, and wherein the elliptically polarized microwaves discharge the discharge lamp.

2. The microwave discharge lamp apparatus of claim 1, further comprising:

an impedance matching unit disposed between the phase shifter and the other end of the rectangular waveguide to perform impedance matching.

3. The microwave discharge lamp apparatus of claim 1, further comprising:

a connecting part disposed between the phase shifter and one end of the cylindrical resonator cavity to fix the cylindrical resonator cavity and having a cylindrical waveguide structure.

4. The microwave discharge lamp apparatus of claim 3, wherein the connecting part and the phase shifter are integrated.

5. The microwave discharge lamp apparatus of claim 1, wherein the cross-shaped waveguide includes a first waveguide and a second waveguide intersecting each other, and wherein the length of the longer side of the cross section of the first waveguide is longer than the length of the longer side of the cross section of the second waveguide.

6. The microwave discharge lamp apparatus of claim 1, wherein the cross-shaped waveguide includes a first waveguide and a second waveguide intersecting each other, and wherein the angle between the first waveguide and the second waveguide is more than 20 degrees and less than 90 degrees.

7. The microwave discharge lamp apparatus of claim 2, wherein the impedance matching unit has an input port to receive the linearly polarized microwaves and an output port to put out the linearly polarized microwaves, and wherein the input port and the output port are formed on both surfaces perpendicular to the propagation direction of the linearly polarized microwaves.

8. The microwave discharge lamp apparatus of claim 2, wherein the impedance matching unit has an input port to receive the linearly polarized microwaves and an output port to put out the linearly polarized microwaves, wherein the input port is formed on a surface perpendicular to the propagation direction of the linearly polarized microwaves, and wherein the output port is formed on a side surface defined by a major-axis direction of the rectangular waveguide and the propagation direction of the linearly polarized microwaves.

9. The microwave discharge lamp apparatus of claim 2, wherein the impedance matching unit includes a pair of stubs extending in a minor-axis direction of the rectangular waveguide, and wherein the pair of stubs are disposed to face each other on both side surfaces defined by a propagation direction of the linearly polarized microwaves and the minor-axis direction of the rectangular waveguide.

10. The microwave discharge lamp apparatus of claim 2, wherein the impedance matching unit includes a pair of recessed portions extending in a minor-axis direction of the rectangular waveguide, and wherein the pair of recessed portions are disposed to face each other on both side surfaces defined by a propagation direction of the linearly polarized microwaves and the minor-axis direction of the rectangular waveguide.

11. The microwave discharge lamp apparatus of claim 2, wherein the impedance matching unit and the rectangular waveguide are integrated.

12. The microwave discharge lamp apparatus of claim 1, wherein the inside of the cross-shaped waveguide of the phase shifter is filled with a dielectric material.

13. The microwave discharge lamp apparatus of claim 1, wherein the cross-shaped waveguide includes a first waveguide and a second waveguide intersecting each other, and which further comprises a dielectric plate disposed within the first waveguide.

14. The microwave discharge lamp apparatus of claim 1, wherein the impedance matching unit comprises:

a first straight portion and a second straight portion spaced apart from each other in the minor-axis direction of the rectangular waveguide; and an oblique portion to connect the first straight portion and the second straight portion to each other.

15. A microwave discharge lamp apparatus which comprises:

a rectangular waveguide which receives microwaves through an opening and one end of which is closed and the other end is open;

a discharge lamp;

a cylindrical resonator cavity, one end of which is open, which is disposed to surround the discharge lamp, and which transmits the light from the discharge lamp to the outside; and a phase shifter, which has a cross-shaped waveguide opened in a propagation direction of the microwaves, and is disposed between the other end of the rectangular waveguide and the cylindrical resonator cavity, and wherein the microwaves propagate in the rectangular waveguide, the phase shifter, and the cylindrical resonator cavity to discharge the discharge lamp.

16. The microwave discharge lamp apparatus of claim 15, wherein the cross-shaped waveguide includes a first waveguide and a second waveguide intersecting each other, and wherein the longer side of the cross section of the first waveguide is longer than the longer side of the cross section of the second waveguide.

17. The microwave discharge lamp apparatus of claim 15, wherein the cross-shaped waveguide includes a first waveguide and a second waveguide intersecting each other, and wherein the angle between the first waveguide and the second waveguide is more than 20 degrees and less than 90 degrees.

* * * * *